US008991725B2

(12) United States Patent
Kah, Jr.

(10) Patent No.: US 8,991,725 B2
(45) Date of Patent: Mar. 31, 2015

(54) PRESSURE REGULATOR IN A ROTATIONALLY DRIVEN SPRINKLER NOZZLE HOUSING ASSEMBLY

(76) Inventor: Carl L. C. Kah, Jr., North Palm Beach, FL (US)

( * ) Notice: Subject to any disclaimer, the term of this patent is extended or adjusted under 35 U.S.C. 154(b) by 486 days.

(21) Appl. No.: 13/327,230

(22) Filed: Dec. 15, 2011

(65) Prior Publication Data

US 2012/0153045 A1 Jun. 21, 2012

Related U.S. Application Data

(60) Provisional application No. 61/423,400, filed on Dec. 15, 2010.

(51) Int. Cl.

| | |
|---|---|
| ***B05B 3/04*** | (2006.01) |
| ***B05B 3/02*** | (2006.01) |
| ***B05B 1/30*** | (2006.01) |
| ***B05B 15/10*** | (2006.01) |
| ***B05B 7/12*** | (2006.01) |

(52) U.S. Cl.

CPC ..... *B05B 7/12* (2013.01)
USPC ..... 239/225.1; 239/203; 239/204; 239/206; 239/240; 239/571

(58) Field of Classification Search

CPC .... B05B 15/10; B05B 3/0418; B05B 3/0422; B05B 3/045
USPC ..... 239/200, 203–206, 225.1, 237, 240, 239/242, 571, 583; 137/505, 505.13, 137/505.14, 505.39, 505.41, 509
See application file for complete search history.

(56) References Cited

U.S. PATENT DOCUMENTS

| | | | | |
|---|---|---|---|---|
| 4,913,352 | A * | 4/1990 | Witty et al. | 239/104 |
| 5,762,270 | A * | 6/1998 | Kearby et al. | 239/205 |
| 5,779,148 | A * | 7/1998 | Saarem et al. | 239/104 |
| 7,681,807 | B2 * | 3/2010 | Gregory | 239/206 |
| 8,794,542 | B1 * | 8/2014 | Hunter et al. | 239/240 |
| 2006/0278727 | A1 * | 12/2006 | Kah, Jr. | 239/67 |
| 2011/0024523 | A1 * | 2/2011 | Sesser et al. | 239/205 |

* cited by examiner

*Primary Examiner* — Darren W Gorman
(74) *Attorney, Agent, or Firm* — Ostrolenk Faber LLP

(57) ABSTRACT

A pressure regulator in a rotationally driven sprinkler nozzle housing assembly includes pressure regulation of the upstream pressure to the sprinkler discharge nozzle and flow throttling. Full shut-off of the sprinkler assembly is provided, if desired. Throttling and pressure regulation are adjustable from the top of the nozzle housing.

17 Claims, 6 Drawing Sheets

PRESSURE REGULATOR IN A ROTATIONALLY DRIVEN SPRINKLER NOZZLE HOUSING ASSEMBLY

CROSS-REFERENCE TO RELATED APPLICATIONS

The present application claims benefit of and priority to U.S. Provisional Patent Application No. 61/423,400 entitled PRESSURE REGULATOR IN A ROTATIONALLY DRIVEN SPRINKLER NOZZLE HOUSING ASSEMBLY, filed Dec. 15, 2010, the entire content of which is hereby incorporated by reference herein.

BACKGROUND

1. Field of the Disclosure

The present disclosure relates to a rotating sprinkler including both pressure regulation and flow throttling provided in the nozzle assembly.

2. Related Art

The benefits of pressure regulation for sprinklers are well known to the irrigation industry such as discussed in the background sections of U.S. Pat. Nos. 4,913,351 and 6,997,393, the entire content of each of which is hereby incorporated by reference herein.

Pressure regulation is typically provided at an inlet in the base of the sprinkler as is described in U.S. Pat. Nos. 4,913,351 and 6,997,393, for example. As a result, in order to install or replace such pressure regulation elements, it is necessary to replace the entire sprinkler.

Accordingly, it would be desirable to provide a sprinkler that includes pressure regulation in the nozzle assembly to allow for easy installation and/or replacement.

SUMMARY

A rotary driven, i.e. water turbine, water driven ball drive, or water reaction driven irrigation sprinkler nozzle assembly in accordance with an embodiment of the present disclosure includes a pressure regulator preferably incorporated into the center of the nozzle assembly body and also includes a reference pressure chamber connected to atmospheric pressure with a spring bias enclosed to bias a pressure responsive movable member that is connected to an upstream pressure balanced flow throttling valve.

The sprinkler includes pressure regulation, flow throttling and flow shut off, if desired.

A sprinkler assembly in accordance with an embodiment of the present application includes a body, a riser movably mounted in the body and in fluid communication with a water supply including a flow path for water provided to the sprinkler assembly from the water supply and a nozzle assembly rotatably mounted on the riser and in fluid communication with the riser. The nozzle assembly may include a center flow passage in fluid communication with the flow path of the riser, a nozzle mounted in the nozzle assembly and in fluid communication with the center flow passage, the nozzle configured to direct water out of the nozzle assembly, and a pressure regulator provided in the nozzle assembly and configured to maintain a desired pressure at an inlet area of the nozzle.

A nozzle assembly for use in a sprinkler assembly in accordance with an embodiment of the present application includes a riser in fluid communication with a water supply including a flow path for water provided to the sprinkler assembly from the water supply and a nozzle housing rotatably mounted on the riser and in fluid communication with the riser. The nozzle housing includes a center flow passage in fluid communication with the flow path of the riser, a nozzle mounted in the nozzle housing and in fluid communication with the center flow passage, the nozzle configured to direct water out of the nozzle housing, and a pressure regulator provided in the nozzle housing and configured to maintain a desired pressure at an inlet area of the nozzle Other features and advantages of the present disclosure will become apparent from the following description of the invention, which refers to the accompanying drawings.

DETAILED DESCRIPTION OF THE EMBODIMENTS

Figure 1:
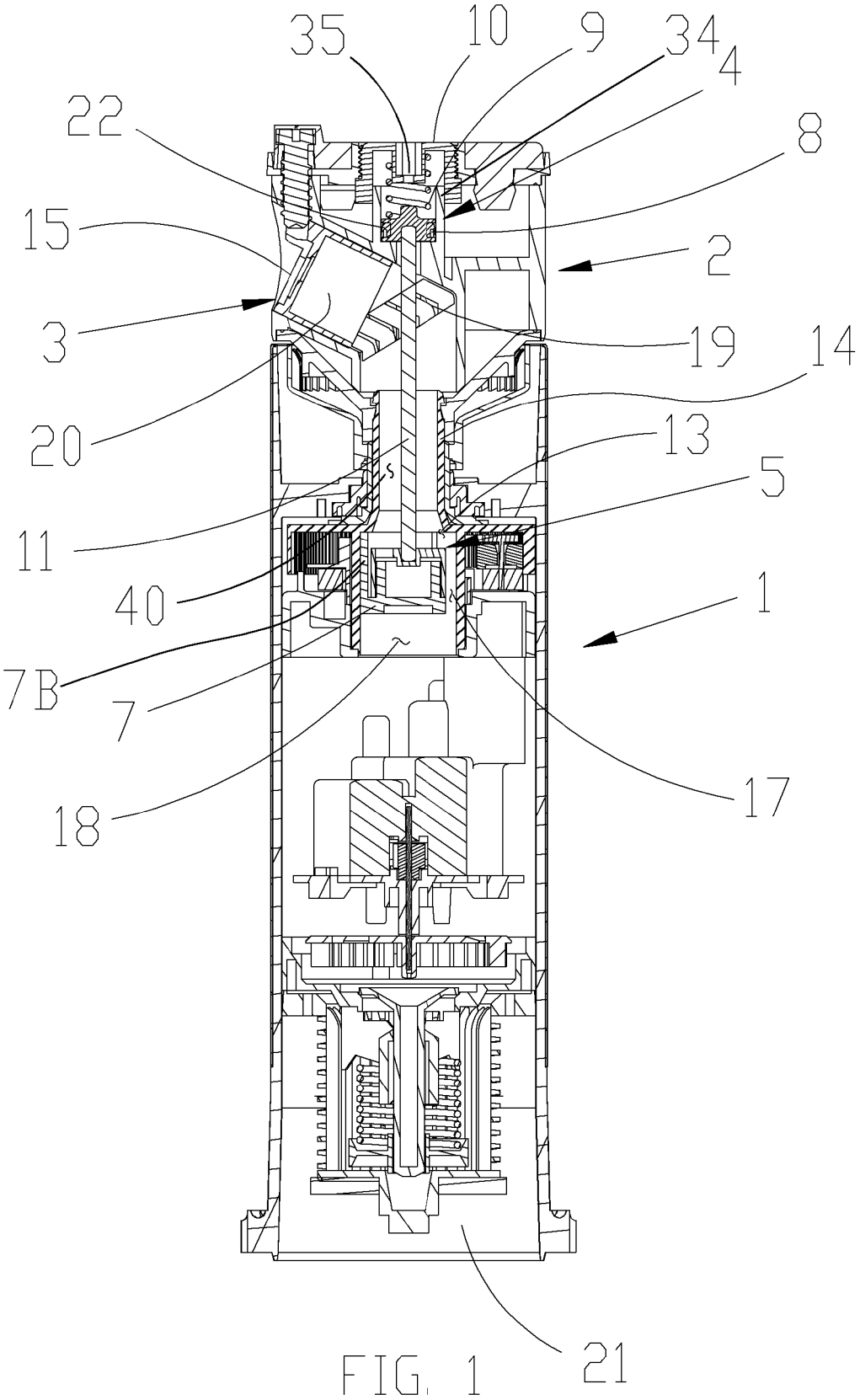
FIG. 1 shows a cross sectional view of a riser assembly and nozzle assembly of a typical water turbine driven sprinkler with a nozzle exit pressure regulator incorporated in the center of the rotating nozzle assembly.

F*igure* 1 illustrates a cross sectional view of a riser 1 and a nozzle assembly 2 of a typical water driven gear drive sprinkler. The nozzle assembly 2 is rotatably mounted on the riser 1, and the riser includes an inlet 21. The details of this type of sprinkler are generally described in U.S. Pat. No. 7,226,003, the entire contents of which are hereby incorporated by reference herein. A nozzle 3 is provided at the outlet of the nozzle assembly 2 to direct water out of the assembly. An exit pressure regulator 4 is incorporated on the center axis of the nozzle assembly 2. A nozzle drive shaft 14 is also provided on the center axis of the nozzle assembly 2.

The pressure regulator 4 preferably includes a cylindrical chamber 34 with a pressure responsive member 8 slidably mounted for axial movement therein. See FIG. 4 also. A low friction sliding lip seal 22 may be provided between the member 8 and the sidewalls of the chamber 34. A bias spring 9 is housed in the pressure chamber 34 above the pressure responsive member 8 and biases the member 8 downward. The chamber 34 is vented to the atmosphere at opening 35. Atmospheric pressure is the preferred reference pressure for the pressure chamber 34. If desired, an opening to the threads 36 may be used as an atmospheric vent instead of the separate opening 35.

The bias spring 9 may be preloaded by screwing the reference chamber top end closure cap 10 downwardly via the threads 36 to increase the preload of bias spring 9 against the top of the pressure responsive member 8.

Figure 3:
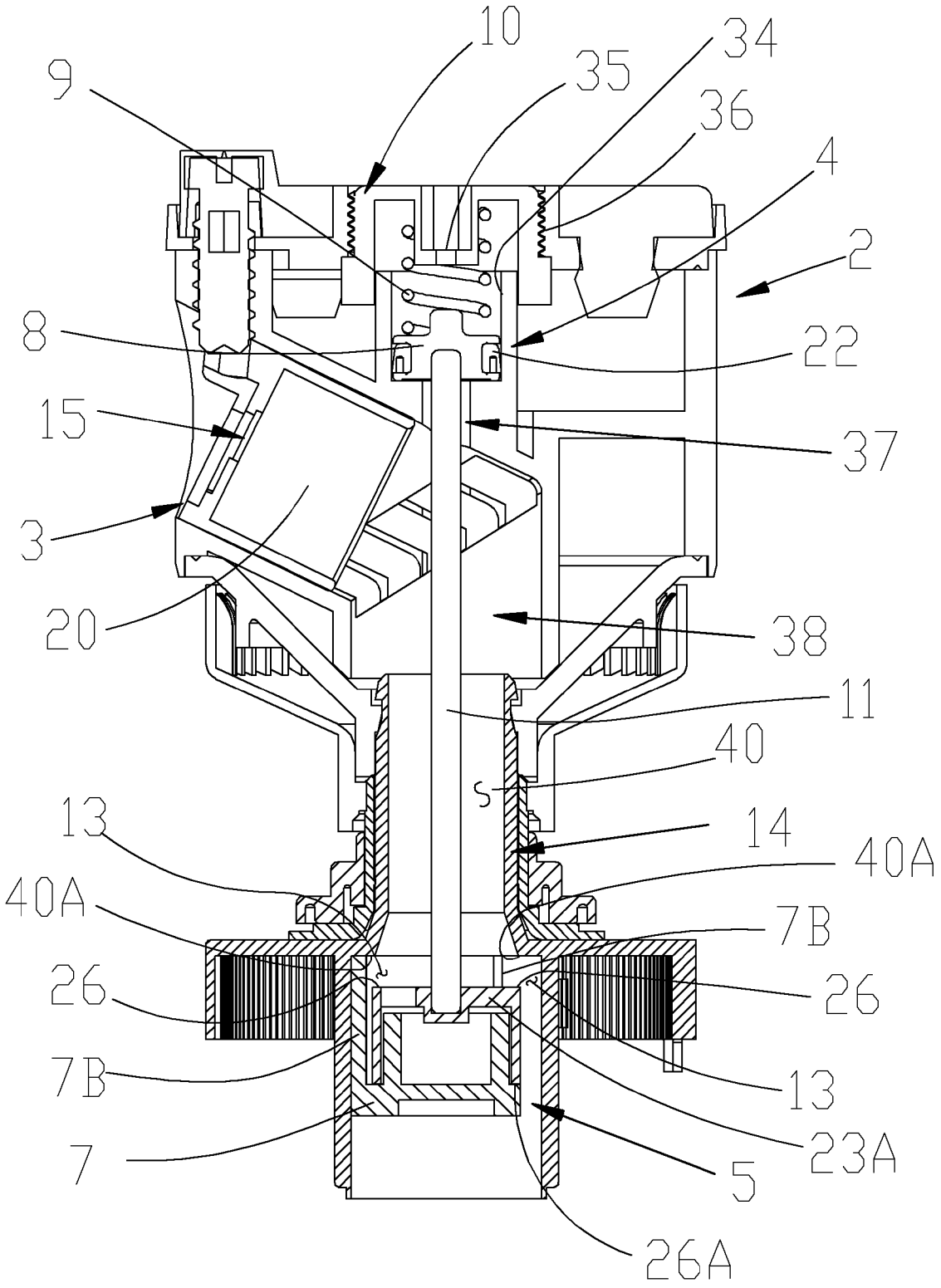
FIG. 3 shows a cross section of the rotating nozzle assembly of FIG. 1 including the drive shaft and a nozzle discharge pressure regulator mechanism.
Figure 4:
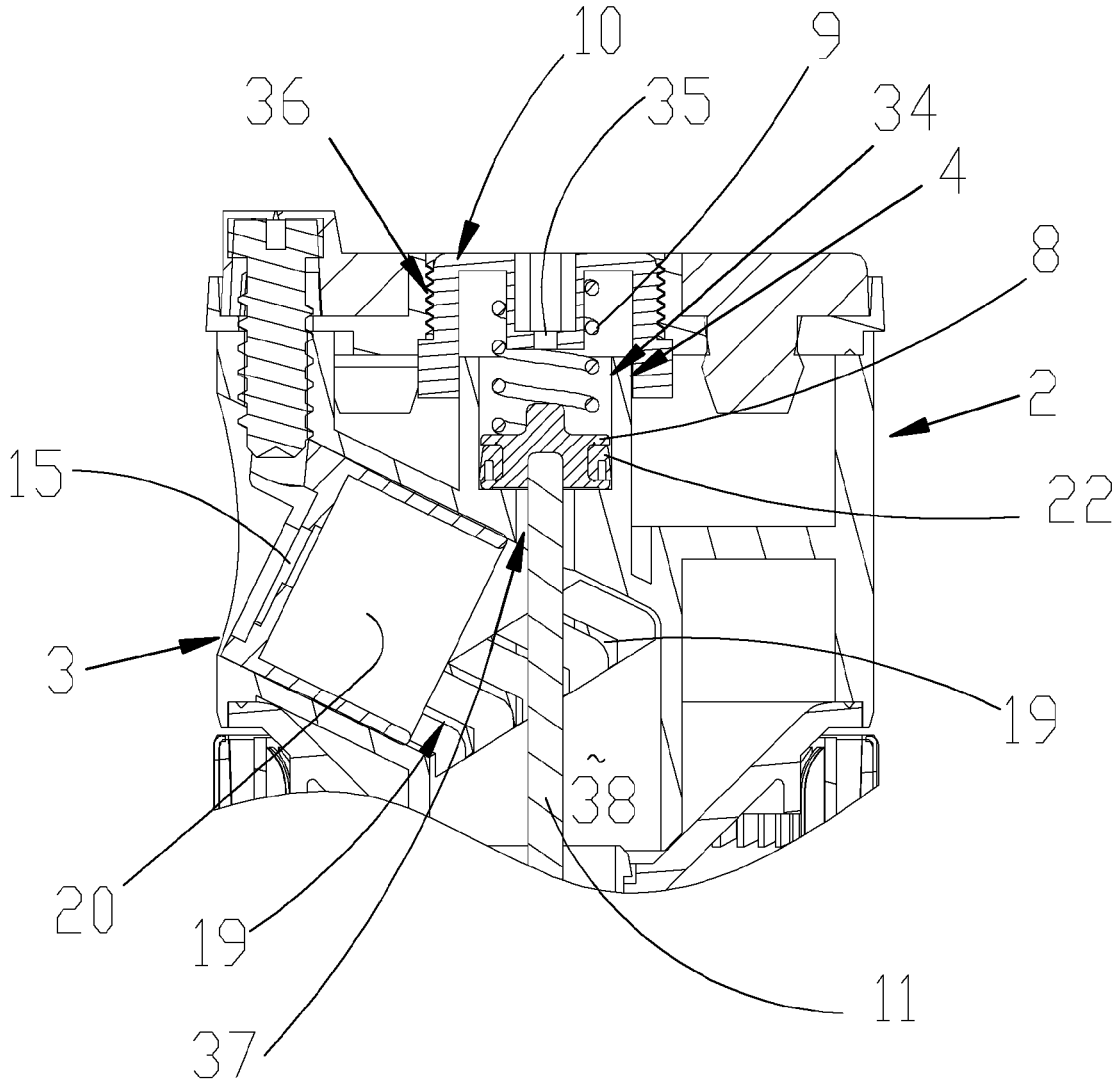
FIG. 4 is an expanded cross sectional line drawing of the upper rotating nozzle assembly of FIG. 1.

Center hole 37 (See FIG. 3) below the pressure responsive member 8 opens into the center flow passage 38 (See FIG. 4)

of the nozzle housing 2. The center flow passage 38 is connected by flow turning vanes 19 to the inlet area 20 of nozzle 3.

As shown, the pressure responsive member 8 is connected by shaft 11 to the upstream cylindrical flow throttling valve member 5. As the pressure at the inlet area 20 of the nozzle 3 rises above a desired level, which may be set by the preload of bias spring 9 on the pressure responsive member 8, the pressure responsive member will move upward against the force of the bias spring 9. This will lift the connecting rod 11 and the flow throttling valve member 5. The flow throttling valve member 5 moves upward to reduce the circumferential flow area 13 that provides flow into internal flow area 40 of the nozzle drive shaft 14 from the upstream area 18. The flow through the nozzle drive shaft 14 exits into the flow path area 38 of the nozzle housing 2 and then onward to the nozzle 3 where it passes through exit area 15 and out of the rotating nozzle housing 2. Reducing the flow area 13 reduces the flow of water into the area 40 and the flow area 38 such that the pressure at the inlet area 20 of the nozzle is decreased as desired to maintain a substantially constant nozzle discharge pressure even for fluctuating or high inlet pressures.

An insert ribbed (see rib 7B) supports center plug 7 for the cylindrical valve member 5 that forces the flow around the outside circumference at 17 of the valve member 5 so that it can be flow controlled at circumferential flow area 13 at the top of the throttling valve member 5. The cylindrical throttling valve member 5 is thus pressure balanced since its upper and lower axial acting pressure surfaces see approximately the same pressure and their axially exposed pressure area is relatively small. The throttling pressure load on the valve member is carried normal (i.e. at an angle of about 90 degrees) to its axis of movement so as to have minimum effect on the pressure responsive member load relative to its bias spring.

The valve member 5 may also be used as a shut off valve to shut off flow to the discharge nozzle 3 completely. The bias spring 9 is axially attached to the top of the pressure responsive member 8 and also to the underside of the threaded cap 10 of the reference pressure chamber 34. Thus, when the cap 10 is rotated in the threads 36 such that the cap backs up out of the chamber 34, the bias of spring 9 will be removed from the pressure regulating member 8. As a result, the entire assembly including pressure regulating member 8, the connecting rod 11 and the valve member 5 will be lifted up to close off the flow through the circumferential area at 13, and thus, shut off flow to the nozzle 3. This will allow a user to change the nozzle 3, for example, without getting wet. Further, since the flow to the nozzle 3 may be turned off without shutting off the water supply to the sprinkler itself, the riser 1 will remain popped up and out of the ground such that the nozzle 3 is easily accessible.

Figure 2:
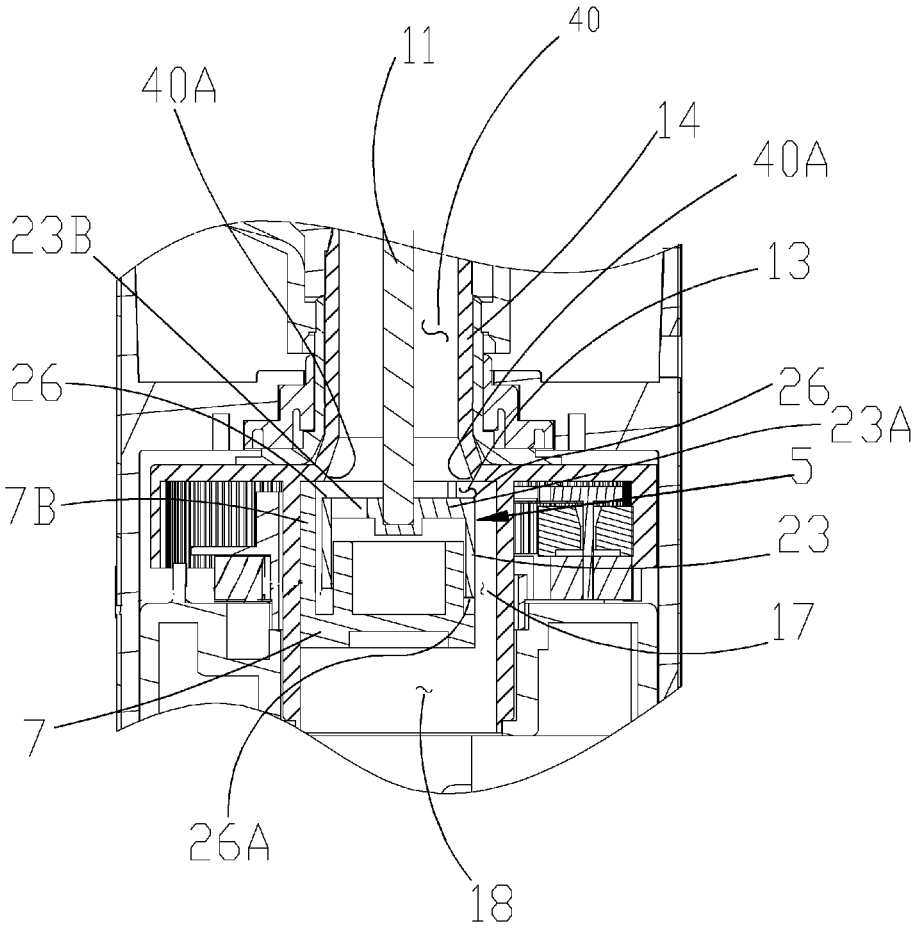
FIG. 2 shows an expanded view of the upstream pressure balanced flow throttling valve in the riser assembly of FIG. 1 which may also be used to throttle the range or shut off flow to the nozzle housing outlet passage where a changeable nozzle is shown installed in the exit side passage of the nozzle housing.
Figure 2B:
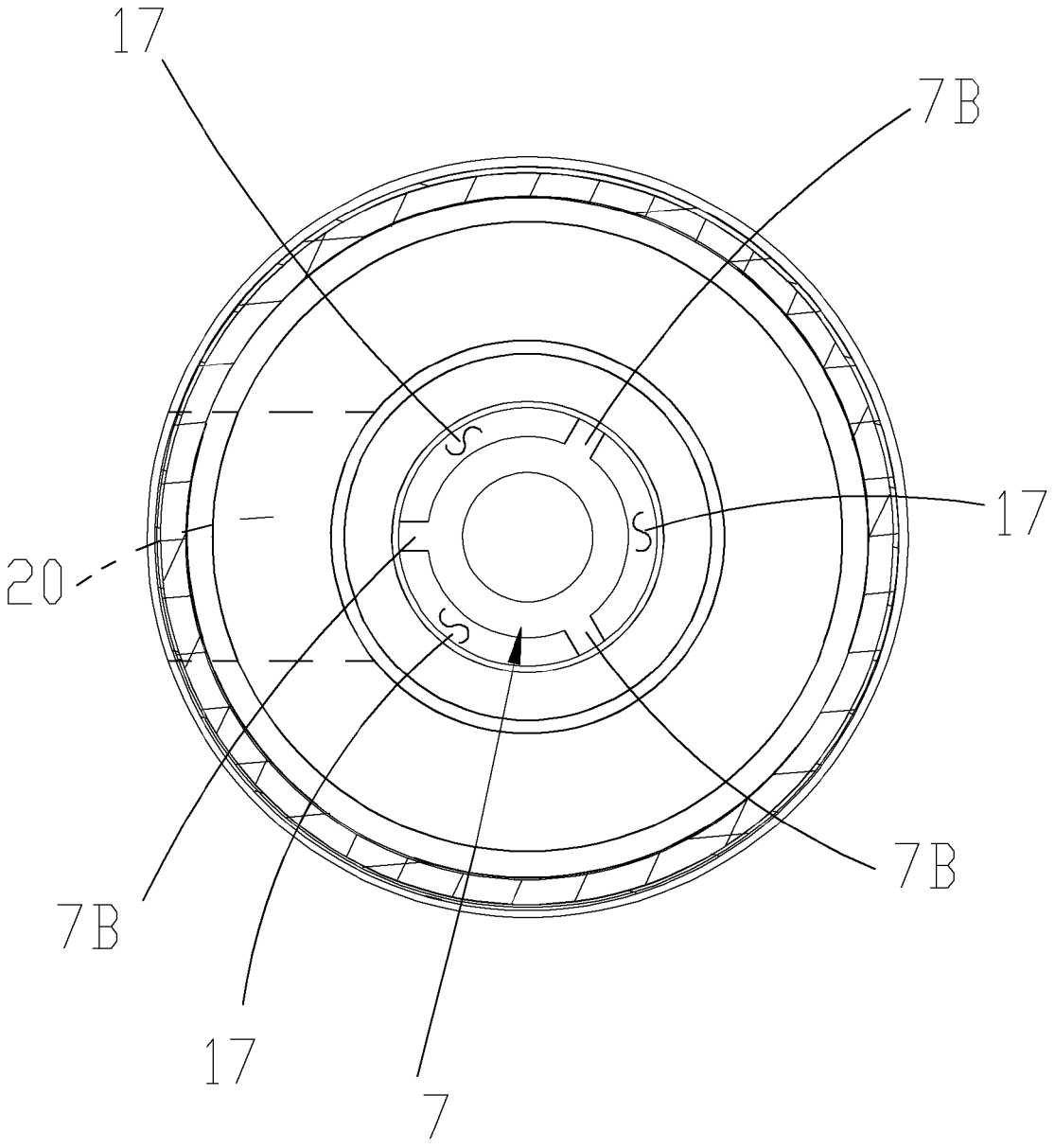
FIG. 2B shows a bottom view of the pressure balanced flow control valve.
Figure 5:
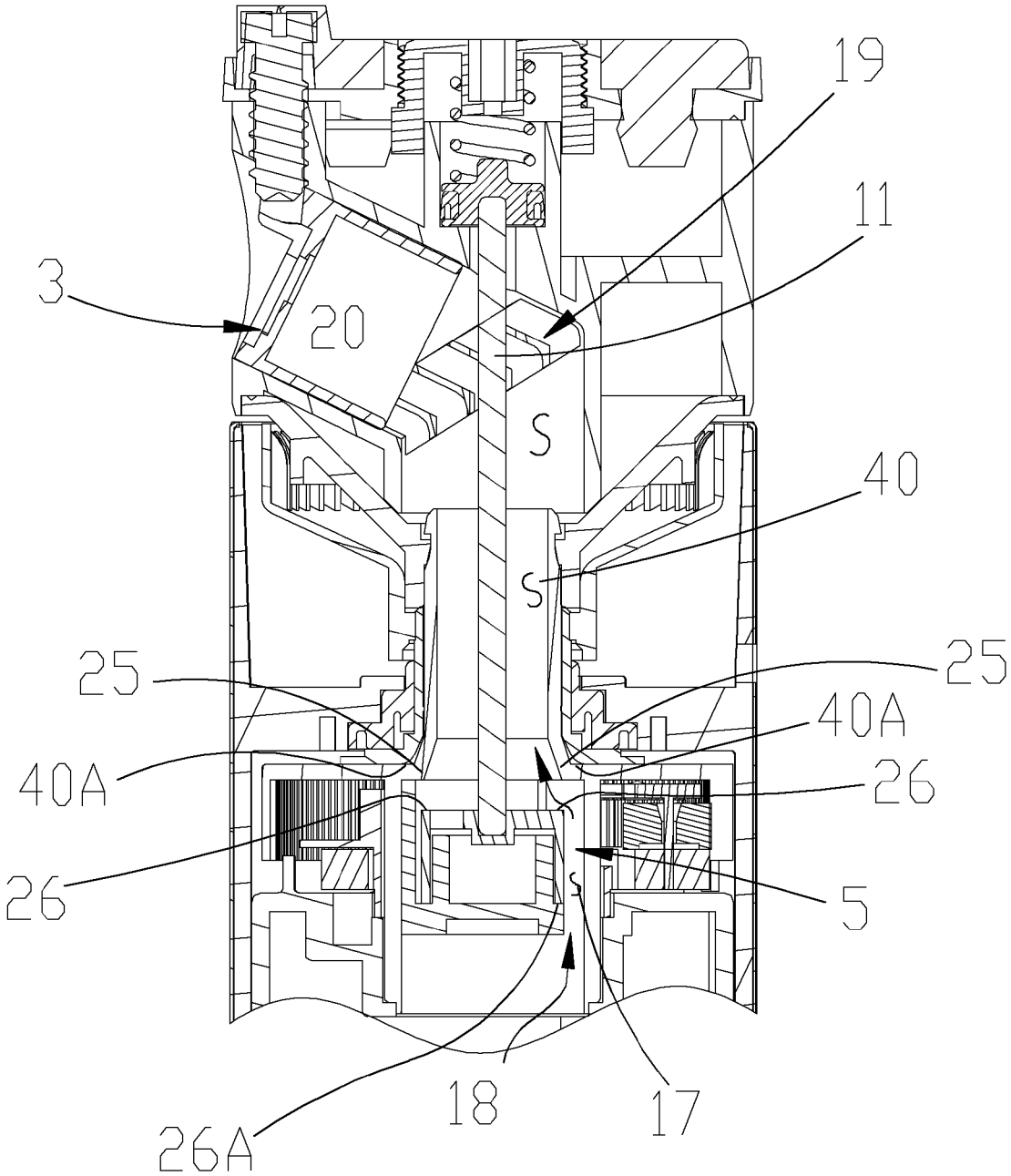
FIG. 5 is an expanded cross sectional line drawing of the upper part of the rotary driven sprinkler of FIG. 1.

The upstream flow throttling valve 5 includes a cylindrical ring 23 supported by ribs 23A from the center activation shaft 11. See FIG. 2, for example. The lower inside area of this cylindrical sleeve valve member is vented in between its support ribs 23A as shown at 23B. Flow throttling occurs between the top of cylindrical edge 26 (see FIG. 5) of the cylindrical valve member, or ring, 23 and the outside circumference of the nozzle drive shaft center hole area 40 at 40A. This cylindrical edge 26 opens and closes the flow area 13 between it and the outer diameter 40A of the flow area 40, upstream of the surface 25 through the nozzle drive shaft 14 and has a minimum axially exposed pressure area which is compensated for by pressure applied at its bottom and the cylindrical edge 26. Thus, there is a minimum axial force applied to the connecting shaft 11 to the pressure responsive piston 8 of the pressure regulator assembly 4 in the upper nozzle housing, which is referred to atmospheric pressure.

Although the present invention has been described in relation to particular embodiments thereof, many other variations and modifications and other uses will become apparent to those skilled in the art.

What is claimed is:

1. A sprinkler assembly comprising:

a riser movably mounted in the sprinkler assembly and in fluid communication with a water supply including a flow path for water provided to the sprinkler assembly from the water supply; and a nozzle assembly rotatably mounted on the riser and in fluid communication with the riser, the nozzle assembly including:

a center flow passage in fluid communication with the flow path of the riser;

a nozzle mounted in the nozzle assembly and in fluid communication with the center flow passage, the nozzle configured to direct water out of the nozzle assembly, and a pressure regulator provided in the nozzle assembly and configured to maintain a desired pressure at an inlet area of the nozzle;

the pressure regulator including:

a reference pressure chamber configured to maintain the reference pressure related to the desired pressure;

a pressure responsive member movably mounted in the reference pressure chamber, a top surface of the pressure responsive member exposed to the reference pressure chamber and a bottom surface exposed to the inlet area of the nozzle;

a biasing member, positioned in the reference pressure chamber and configured to apply a predetermined biasing force on the pressure responsive member; and a member secured to the nozzle assembly and movable to modify the biasing force of the biasing member.

2. The sprinkler assembly of claim 1, wherein the riser further comprises a flow control element connected to the pressure regulator such that the flow control element reduces the flow of water to the nozzle assembly when pressure at the inlet area of the nozzle exceeds a reference pressure.

3. The sprinkler assembly of claim 2, further comprising a drive shaft connecting the nozzle assembly to the riser, wherein the flow path in the riser to the nozzle is formed in the drive shaft.

4. The sprinkler assembly of claim 1, wherein the member secured to the nozzle assembly is a cap.

5. The sprinkler assembly of claim 3, the flow control element further comprising:

a connecting rod connected at a top end to the pressure responsive member; and a valve element connected to a bottom end of the connecting rod, and positioned adjacent to an inlet of the drive shaft, wherein the connecting rod and valve member are movable with the pressure responsive member to adjust the flow of water into the drive shaft.

6. The sprinkler assembly of claim 4, wherein the cap further comprises an opening configured to expose the reference pressure chamber to atmospheric pressure, such that the reference pressure is substantially atmospheric pressure.

7. The sprinkler assembly of claim 5, wherein the valve element further comprises a throttling element configured to completely block the inlet of the drive shaft when the valve element is in a throttling position.

8. The sprinkler assembly of claim 7, wherein the biasing member is removable from the reference pressure chamber entirely such that the throttling element is pushed up by water pressure into the throttling position to block the inlet of the drive shaft and stop the flow of water to the nozzle assembly.

9. The sprinkler assembly of claim 1, wherein the nozzle is removably mounted in the nozzle assembly.

10. A nozzle assembly for use in a sprinkler assembly comprising:

a riser in fluid communication with a water supply including a flow path for water provided to the sprinkler assembly from the water supply; and a nozzle housing rotatably mounted on the riser and in fluid communication with the riser, the nozzle housing including:

a center flow passage in fluid communication with the flow path of the riser;

a nozzle mounted in the nozzle housing and in fluid communication with the center flow passage, the nozzle configured to direct water out of the nozzle housing, and a pressure regulator provided in the nozzle housing and configured to maintain a desired pressure at an inlet area of the nozzle;

the pressure regulator including:

a reference pressure chamber configured to maintain a reference pressure;

a pressure responsive member movably mounted in the reference pressure chamber, a top surface of the pressure responsive member exposed to the reference pressure chamber and a bottom surface thereof exposed to the inlet area of the nozzle; and a biasing member, positioned in the reference chamber and configured to apply a predetermined biasing force on the pressure responsive member.

11. The nozzle assembly of claim 10, wherein the riser further comprises a flow control element connected to the pressure regulator such that the flow control element reduces the flow of water to the nozzle housing when pressure at an the inlet area of the nozzle exceeds the desired pressure.

12. The nozzle assembly of claim 11, further comprising a drive shaft connecting the nozzle assembly to the riser, wherein the flow path is formed in the drive shaft.

13. The nozzle assembly of claim 10, wherein the pressure regulator further comprises a cap, secured to the nozzle housing and movable into the reference pressure chamber to modify the biasing force of the biasing member.

14. The nozzle assembly of claim 12, further comprising:

a connecting rod connected at a top end to the pressure responsive member; and a valve element connected to a bottom end of the connecting rod, and positioned adjacent to an inlet of the drive shaft, wherein the connecting rod and valve member are movable with the pressure responsive member to adjust the flow of water into the drive shaft, the valve element including a throttling element configured to completely block the inlet of the drive shaft when the valve element is in a throttling position.

15. The nozzle assembly of claim 13, wherein the cap further comprises an opening configured to expose the reference pressure chamber to atmospheric pressure, such that the reference pressure is substantially atmospheric pressure.

16. The nozzle assembly of claim 14, wherein the biasing member is removable from the reference chamber entirely such that the throttling element is pushed up by water pressure into the throttling position to block the inlet of the drive shaft to stop the flow of water to the nozzle assembly.

17. The nozzle assembly of claim 10, wherein the nozzle is removably mounted in the nozzle housing.

* * * * *